United States Patent [19]

Sakata

[11] Patent Number: 4,517,539

[45] Date of Patent: May 14, 1985

[54] MEGNETIC DEVICE

[75] Inventor: Yoshio Sakata, Yamato, Japan

[73] Assignee: Kanegafuchi Kagaku Kogyo Kabushiki Kaisha, Osaka, Japan

[21] Appl. No.: 499,270

[22] Filed: May 31, 1983

[30] Foreign Application Priority Data

Jun. 1, 1982 [JP] Japan ..... 57-81427[U]

[51] Int. Cl.[3] ..... H01F 7/02

[52] U.S. Cl. ..... 335/302; 335/303; 118/657; 118/658

[58] Field of Search ..... 335/302, 303, 306; 355/3 DD; 118/657, 658

[56] References Cited

U.S. PATENT DOCUMENTS

| | | | |
|---|---|---|---|
| 3,176,652 | 4/1965 | Mott et al. | 118/658 |
| 3,572,289 | 3/1971 | Maksymiak | 118/658 |
| 4,222,021 | 9/1980 | Bunker | 335/303 |
| 4,303,331 | 12/1981 | Thompson | 355/3 DD |

*Primary Examiner*—George Harris

*Attorney, Agent, or Firm*—Fleit, Jacobson, Cohn & Price

[57] ABSTRACT

Bonded magnets are aligned around a shaft so as to form a roller shape magnetic body as shown in FIG. 2. In this case, a magnet A′ having a portion B which does not change the breadth of a magnet in the circumferential direction even if the distance from the center of revolution changes, is arranged.

10 Claims, 3 Drawing Figures

MEGNETIC DEVICE

BACKGROUND OF THE INVENTION

This invention relates to a magnetic device which makes possible the alignment of magnetic poles having a high precision as is required for a magnet roller for a plain paper copier.

Heretofore, there has been used a magnet roller for a plain paper copier wherein cylindrical or bar shape sintered ferrite magnets are aligned around a shaft. However, there has been a recent trend towards adopting a so-called bonded magnet which comprises mixing and dispersing ferro-magnetic fine powders in rubbers or resin matrices of plastic or the like because of difficulties in treating sintered magnets in an assembling step caused by the fragility of the sintered magnet, usually the result of crack or breakage, etc. caused by an impact or a vibration after assembling combined with the high cost of sintered magnets. Although the bonded magnet has several characteristics not present in the sintered ferrite magnet, said bonded magnet has a defect which decreases the magnetic characteristics due to its fundamental nature wherein the magnetic substance is diluted by the resin matrices. For avoiding this defect, an "orientation" is adopted which arranges the C-axis direction in the ferrite crystal, as a method of increasing the characteristic of the magnet. In addition, there exists a method of providing a high magnetic flux density by improving the permeance of the magnet, the bonded magnet having a resinous nature, thereby being able to easily form an intended profile cross section.

SUMMARY OF THE INVENTION

This invention is performed to obtain the characteristics required for the magnetic roller, namely the stability of a position for the magnetic poles by increasing the magnetic characteristics and improving the permeance.

BRIEF DESCRIPTION OF THE DRAWINGS

The drawings represent sectional areas of a magnetic device for aligning magnets (portions of inclined lines) around the shaft, thereby forming a roller magnetic body.

In FIGS. 2 and 3, l′ and l″ are the breadth of portion B which remains constant as material is removed from the periphery of the cylinder of revolution of the bonded magnets.

In FIG. 2, first surface portion 2 lies coincident with the periphery of the cylinder of revolution of the magnet A′. Second surface 4 is located spaced from the first surface portion and lies coincident with the periphery of the cylinder of revolution. Parallel surfaces 6 and 8 extend radially inwardly from opposite ends of second surface 4. Surfaces 10 and 12 lie within the periphery of the cylinder of revolution and connect the radially inner edge of one of the pair of parallel surfaces 8 with one end of the first surface portion 2 and surface 14 lying within the periphery of the cylinder of revolution connects the radially inner edge of surface 6 with the other end of the first surface portion 2. The magnet A′ includes at least one magnet with at least a portion being bounded at its periphery by the second surface 4 and the parallel surfaces 6 and 8.

In FIG. 3, first surface portion 16 lies coincident with the periphery of the cylinder of revolution of the magnet A″. Second surface portion 18 lies spaced from first surface portion 16 and also lies coincident with the periphery of the cylinder of revolution of the magnet A″. Parallel surfaces 20 and 22 extend radially inwardly from opposite ends of the second surface portion 18. Surfaces 24 and 26 lie within the periphery of the cylinder of revolution and connect the radially inner edges of parallel surfaces 20 and 22 with opposite ends of the first surface portion 16.

DETAILED DESCRIPTION OF THE INVENTION

Figure 1:
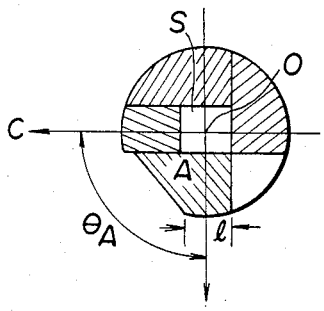
FIG. 1 is a conventional magnetic device.
Figure 2:
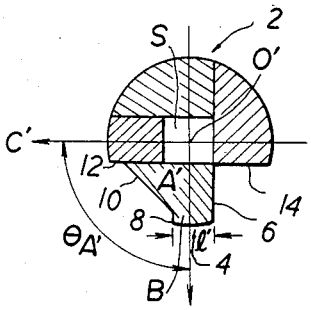
PRIOR ART FIG. 2
FIG. 2 is an example of a magnetic device in accordance with this invention and FIG. 3 is another embodiment of this invention. In the Figures, S; C, C′, C″; and O, O′, O″ represent, shaft; directions which are standards of the magnetic poles; and centers of revolutions of the roller magnetic bodies, respectively. Further, $\theta_A$, $\theta_{A'}$, and $\theta_{A''}$ are angles which show positions of magnets A, A′ and A″ in magnet patterns respectively; B is a portion of the bonded magnet in which the breadth of the magnet does not change when moving from the center toward the circumferential direction of the magnet, even if the distance from the center of the revolution is decreased; and l, l′ and l″ are breadths across a circumferential portion of each magnet in the circumferential directions respectively.
Figure 3:
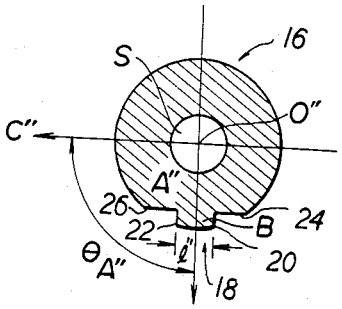

This invention is described with reference to the embodiment shown in FIG. 2. In order to improve the permeance and strengthen the magnetic flux density, there exists a method of narrowing the breadth of a magnet (magnet A in FIG. 1) across the circumference of the roller from a distance extending toward the center thereof. This method is already practised by this inventor as a simple and effective method in a design of the magnetic device. However, the roller shape magnetic body generally requires a high dimensional precision. For this purpose, a cutting of the circumference thereof is generally performed. However, in this case, dispersion occurs along a length of the circumferential direction of the magnet A on the surface of the circumference due to the cutting. This causes the dispersion distribution patterns of magnetic flux such as the shape of magnet poles and the position of the magnet pole relative to the circumferential direction of the roller shape magnetic body, thereby causing an undesirable decrease of the performance of said roller shape magnetic body.

In order to solve such defects, the inventor investigated the shape of the sectional area of magnet A. As a result, it is found that when the magnets are aligned to form a roller shape magnet body on the shaft as shown in FIG. 2, a magnet A′ having such sectional area wherein a portion B which does not change in breadth along the circumferential direction may may be the same distance across the surface of the circumference even if the distance from the center of revolution O′ changes, by the removal of some of the circumference of the magnetic body by cutting and thereby achieves the required constant properties for a bonded magnet. In other words, when the distance from said center of revolution O′ is subjected to cutting in order to increase the precision of the dimension of the magnetic body by cutting the portion B, there is no change of length along the circumferential direction in the magnet A′ in the portion B even with a decrease in the radial distance of the outer surface 4 or 18 of B from center O′. Therefore, the dispersion of the magnetic pattern is small as shown in Table 1 when comparing the case wherein the magnet breadth is narrowed along the surface of the circumference to increase the magnetic characteristic as in the magnet of FIG. 1. Therefore, the present invention is being able to obtain a remarkable improvement in the performance of the roller shape magnetic body.

TABLE 1

| | dispersion ($\sigma$) of position of magnetic pole ($\theta_A$, $\theta_{A'}$) from the standards C, C' |
|---|---|
| case having no portion B | 1.9° |
| case having portion B | 0.9° |

What I claim is:

1. A magnetic body defining an axis comprised of at least one magnet, the revolution of said body about its axis defining a cylinder of revolution having a circular cross section, spaced first and second surface portions of the body lying coincident with the periphery of the cylinder of revolution, a pair of parallel surfaces defined by the body extending radially inwardly from opposite ends of said second surface, and surface means lying within the periphery of the cylinder of revolution connecting the radially inner edges of said parallel surfaces with opposite ends of the first surface, said body including at least one magnet at least a portion of which is bounded by said second surface and said parallel surfaces.

2. A magnetic body as claimed in claim 1, wherein said parallel surfaces intersect said surface means at 90° angles.

3. A magnetic body as claimed in claim 1, wherein one of said parallel surfaces intersects said surface means at an angle of 90°.

4. A magnetic body as claimed in claim 1, wherein one of said parallel surfaces intersects said surface means at an angle greater than 90°.

5. A magnetic body as claimed in claim 1, wherein said parallel surfaces are perpendicular to the chord of said second surface.

6. A magnetic body as claimed in claim 1, wherein one of said parallel surfaces intersects said surface means at an angle of 90° and one of said parallel surfaces intersects said surface means at an angle greater than 90°.

7. A magnet device comprising a shaft, a magnet roller having at least one bonded magnet around said shaft, a portion of said at least one magnet having a constant breadth at its outer circumferential portion so that its breadth in a circumferential direction is constant even as the distance from the center of revolution to the outer circumference changes.

8. A magnet device according to claim 7, wherein said portion of said at least one bonded magnet has a non-symmetric sectional area from its center of revolution in a radial direction.

9. A magnet device according to claim 7, wherein said portion of at least one bonded magnet narrows in its breadth toward its outer circumference.

10. A magnet device according to claim 7, wherein said at least one bonded magnet is composed of an orientated ferro-magnet-resin compound.

* * * * *